United States Patent [19]

Abe et al.

[11] 4,088,860

[45] May 9, 1978

[54] VACUUM INTERRUPTER FOR HIGH VOLTAGE APPLICATION

[75] Inventors: Nobuo Abe, Ibaraki; Hiroyuki Sugawara, Hitachi, both of Japan

[73] Assignee: Hitachi, Ltd., Japan

[21] Appl. No.: 685,533

[22] Filed: May 11, 1976

[30] Foreign Application Priority Data

May 16, 1975 Japan ..... 50/58056

[51] Int. Cl.[2] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,189,715 | 6/1965 | Jennings | 200/144 B |
| 3,231,704 | 1/1966 | Jacobs | 200/144 B |
| 3,355,564 | 11/1967 | Ranheim | 200/144 B |
| 3,792,214 | 2/1974 | Voshall | 200/144 B |
| 3,889,080 | 6/1975 | Emmerich et al. | 200/144 B |
| 3,903,386 | 9/1975 | Yanagisawa | 200/144 B |

*Primary Examiner*—Robert S. Macon
*Attorney, Agent, or Firm*—Craig & Antonelli

[57] ABSTRACT

A vacuum interrupter including an insulating cylindrical body, a pair of opposed separable stationary and movable electrodes respectively secured to respective stationary and movable holders, a bellows positioned between the movable holder and the insulating cylindrical body for permitting the movable electrode to be separated from the stationary electrode. An intermediate metal shield is positioned between the insulating cylindrical body and the electrodes with a first cylindrical metal shield and an end-plate cylindrical metal shield opposed to the intermediate metal shield being positioned at the stationary holder side, and a movable shield having a diameter greater than that of the intermediate metal shield and opposed to the bellows being positioned at the movable holder side, whereby the inner surface of the insulating cylindrical body as well as the bellows are protected from metal particles produced at the time of interrupting a current.

10 Claims, 3 Drawing Figures

VACUUM INTERRUPTER FOR HIGH VOLTAGE APPLICATION

FIELD OF THE INVENTION

This invention relates to a vacuum interrupter for use in a vacuum breaker, and more particularly to a vacuum interrupter of the type described, which may protect the inner surface of an insulating cylindrical body and a bellows from metal particles produced at the time of breaking a current, and which presents an excellent voltage-withstand performance as a vacuum interrupter of a high votage class.

DESCRIPTION OF THE PRIOR ART

A vacuum breaker interrupts a current by separating a pair of electrodes, one from the other, within a container which is maintained at a high vacuum level, and by utilizing the arc diffusing action in vacuum, finds a wide application as a small-sized and light-weight breaker. An insulating cylindrical body is used as part of a closed container of a vacuum interrupter serving as a current breaking portion of a vacuum breaker. When metal particles evaporated from electrodes at the time of breaking a current cling to the inner surface of the insulating cylindrical body, then the voltage-withstanding performance of the inner surface of the insulating cylindrical body on a vacuum side is lowered. In general, a metal shield or shields are provided within a closed container for preventing the aforesaid lowering of the performance. In this connection, the aforesaid metal shields should meet the following requirements, namely, (i) protecting or covering the inner surface of the insulating cylindrical body to thereby protect same from clinging of metal particles thereto, and (ii) providing a construction and arrangement so as not to lower its voltage-withstanding performance.

Unless these requirements are met, a vacuum interrupter which may be operated in a satisfactory manner may not be achieved. Since a bellows is used in a vacuum interrupter for permitting one of the electrodes to move, the vacuum interrupter suffers from disadvantages in that an intermediate metal shield positioned in the vicinity of electrodes in the center portion of a closed container can not be maintained at an intermediate potential at the completion of an breaking action, and in that metal particles could not be well prevented from their clinging to the aforesaid inner surface of the insulating cylindrical body and bellows.

Meanwhile, an attempt to provide metal shields which sufficiently cover the inner surface of the aforesaid insulating cylinder for preventing clinging of metal particles thereto with the view to improving a voltage-withstanding performance, has been disclosed in U.S. Pat. No. 3,792,214 filed by Roy E. Voshall.

According to the vacuum interrupter disclosed therein, four insulating cylindrical members, each having metal flanges on their opposite ends, are positioned in opposed relation to each other on a common axis, thereby forming a single insulating cylindrical body, while end plates are secured to metal flanges positioned at the opposite ends of the aforesaid single insulating cylindrical body, thereby providing a vacuum container.

Positioned in the axially central portion of the insulating cylindrical body are a pair of separable electrodes secured to respective electrode holders.

Provided in a surrounding relation to a movable electrode holder to which a movable electrode is secured, is a bellows-shield which protects one end of a bellows and even the remaining portion of the bellows from metal particles, while the other end of the bellows is secured to a movable electrode side end plate. In addition, a stationary electrode holder to which is secured a stationary electrode, is secured to a stationary electrode side end plate.

Main-cylinder-central shields secured to the metal flanges in the axially central portion of the aforesaid insulating cylindrical body surround the outer peripheries of the aforesaid separable pair of electrodes, and are positioned inwardly of the insulating cylindrical body on the stationary and movable electrode sides. The end portion of the main-cylinder-central shield on the stationary electrode side is surrounded by a first end shielding cylinder which is electrically insulated from the main cylinder shield and the stationary electrode holder and secured to the metal flanges of the insulating cylindrical body, the first shielding cylinder extending inwardly of the insulating cylindrical body in the direction of the stationary electrode side end plate.

Secured to the stationary electrode side end plate is a third end portion shielding cylinder, the other end of which extends inwardly of the insulating cylinder in a manner to surround the end portion of the aforesaid first end shielding cylinder.

As has been described above, the shielding cylinders provided on the stationary electrode side are arranged so as to extend in the axial direction in overlapping relation to each other.

A second end-shielding cylinder and a fourth end-shielding cylinder are provided on the main-cylinder-central shield side and the movable electrode said, which are identical in shape or construction to those of the first and the third end-shielding cylinder.

The vacuum interrupter which has been described above uses shielding cylinders of the same configuration, which are positioned in symmetric relation in the axial direction relative to the surfaces of electrodes which are separable from each other, thereby preventing clinging of metal particles produced at the time of breaking a current, to the inner surface of the insulating cylindrical body, as well as providing uniform distribution of voltage on the outer peripheral surface of the insulating cylindrical body and across the respective shielding cylinders.

However, the vacuum interrupter of such an arrangement functions satisfactorily, for a rated voltage up to 34 kV. The folllowing problems, however, are encountered, when the vacuum interrupter is used at a rated voltage of over 34 kV.

For example, with the vacuum interrupter of a high voltage class, a gap between electrodes should be increased. An increase in gap leads to an increase of the free length of a bellows.

In case a bellows having an increased free length is used, the bellows tends to be extended or compressed, following a zig-zag pattern, i.e., causing buckling. To prevent this, the diameter of the bellows should be increased. An increased diameter of the bellows, when it comes close to the tip portion of the second end-shielding cylinder, lowers the voltage-withstanding performance thereof.

To solve this problem, (i) the diameter of the tip of the second end-shielding cylinder should be increased, and (ii) the second end-shielding cylinder should be removed. However, the aforesaid attempt (i) leads to an increase in diameter of the fourth end-shielding cylinder, and in addition, the fourth cylinder comes close to the insulating cylindrical body, so that uniformity in an electric field can no longer be maintained, with the resulting lowered voltage-withstanding performance. For achieving a uniform electric field, the diameter of the insulating cylindrical body should be increased, and the configuration of the aforesaid respective shields positioned on the side of the stationary electrode should be the same as those of the shields on the side of the movable electrode. However, this dictates an increase in size of the vacuum interrupter.

In addition, the aforesaid attempts (ii) lowers the voltage-withstanding performance, because metal particles produced at the time of breaking a current directly cling to the inner surface of the insulating cylinder.

In either case, the second end-shielding cylinder provided in a manner to surround a bellows shield results in difficulty in maintaining the voltage-withstanding performance of the vacuum interrupter of a high voltage class.

SUMMARY OF THE INVENTION

It is an object of the present invention to provide a vacuum interrupter for use in a vacuum breaker, which is capable of protecting the inner surface of an insulating cylindrical body and a bellows from clinging of metal particles produced at the time of breaking a current, and provides metal shielding cylinders of a shape enabling uniform distribution of voltage on the outer surface of the insulating cylinder body and which may be well adapted for use in a high voltage class vacuum breaker, because of its excellent voltage-withstanding performance.

The above object may be attained in a vacuum interrupter for use in a vacuum breaker according to the present invention, in which at least two insulating cylindrical members are disposed in coaxial relation to each other and mated together to form a single insulating cylindrical body; a pair of movable and stationary electrodes which are separable from each other are positioned within the insulating cylindrical body; an intermediate metal shield which is electrically insulated from the aforesaid electrodes is positioned within the insulating cylindrical body in a manner to surround the aforesaid pair of electrodes; the aforesaid intermediate metal shield and at least two cylindrical metal shields are positioned on the stationary electrode holder side; the aforesaid intermediate metal shield and the aforesaid at least two cylindrical metal shields are opposed to each other in the axial direction, with the ends thereof being overlapped in the axial direction; the intermediate metal shield and at least one movable shield are positioned in opposed relation to each other on the movable electrode holder side; and the diameter of the movable shield is larger than the diameter of the aforesaid intermediate metal shield or the diameter of another metal shield secured to a potential portion other than the aforesaid intermediate metal shield.

DESCRIPTION OF THE PREFERRED EMBODIMENTS

Figure 1:
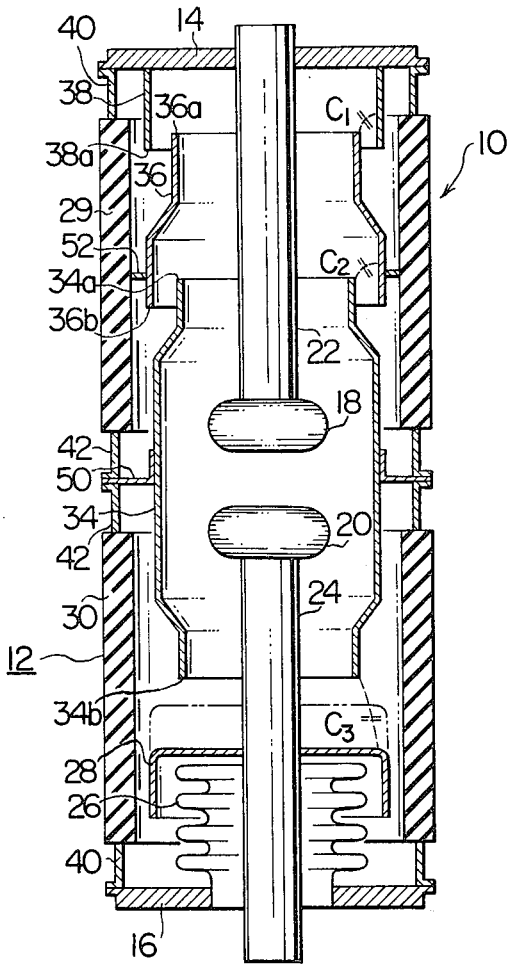
FIG. 1 is a longitudinal cross-sectional view of a vacuum interrupter, showing one embodiment of the present invention.

A vacuum interrupter 10 embodying the present invention shown in FIG. 1 includes an insulating cylindrical body 12, a stationary electrode side end plate 14, a movable electrode side end plate 16, a stationary electrode 18 and a movable electrode 20. The cylindrical body 12 includes two cylindrical or insulating cylinders 29, 30. Metal flanges 40, 42 are secured to the respective opposite ends of the insulating cylinders 29, 30, and these flanges 40, 42 have substantially the same coefficient of thermal expansion as those of the insulating cylinders 29, 30. The stationary electrode side end plate 14 and the movable electrode side end plate 16 are welded to the metal flanges 40 secured to the insulating cylinders 29, 30, presenting air-tight joints therebetween. A stationary electrode 18 and a movable electrode 20 are positioned within the insulating cylindrical body 12, and brazed to a stationary electrode holder 22 and a movable electrode holder 24, respectively.

The stationary electrode holder 22 is welded to the stationary electrode side end plate 14.

A bellows 26 maintains air tightness within the insulating cylindrical body 12 and one end thereof being secured to the movable electrode holder 24 and the other end thereof being secured to the movable electrode side end plate 16 in a manner to permit axial movement of the movable electrode holder 24.

Secured to the movable electrode holder 24 is a movable shield 28 made of stainless steel, nickel or the like, in a manner to cover the bellows 26.

The movable electrode holder 24 is coupled to a drive mechanism (not shown). The movable electrode shown in FIG. 1 is in its breaking position. When the interrupter is actuated, the movable electrode 20 contacts the stationary electrode 18 to permit a current to flow in turn through the movable electrode holder 24, movable electrode 20, stationary electrode 18 and stationary electrode holder 22. An intermediate metal shield 34 is secured to a supporting metal piece 50 in a manner to surround the stationary electrode 18 and the movable electrode 20, while the supporting metal piece 50 is coupled to the metal flanges 42 of the insulating cylinders 29, 30 in an air-tight relation.

The intermediate insulating metal shield 34 is positioned inwardly of the insulating cylinders 29, 30 and electrically insulated from the stationary electrode 18 and the movable electrode 20, respectively. The diameter of the movable shield 28 positioned in opposed relation to the intermediate metal shield 34 is larger than the diameter of the end portion **34*b* of the intermediate metal shield 34**.

Positioned between the stationary electrode 18 and the stationary electrode side end plate 14 is a first cylindrical metal shield 36 and an end-plate cylindrical metal shield 38. The first cylindrical metal shield 36 is secured to the insulating cylinder 29 through the medium of a supporting metal piece 52 to a potential portion other than where the intermediate metal shield 34 is secured, while the end-plate cylindrical metal shield 38 is secured to the end plate 14 on the stationary electrode side. The aforesaid intermediate metal shield 34, first cylindrical metal shield 36 and end-plate cylindrical metal shield 38 are all made of a stainless steel, nickel or the like, and are electrically insulated from each other, with the opposed end portions **34*a*, 36*b* and 36*a*, 38*a* are positioned in an overlapping relation coaxial to the insulating cylindrical body 12**.

As has been described above, the vacuum interrupter 10 according to one of embodiments of the present invention is of an arrangement such that the aforesaid respective metal shields 28, 34, 36 and 38 positioned within the insulating cylindrical body 12 are positioned in asymmetrical relation in the axial direction with respect to the contacting surfaces of the stationary electrode 18 and movable electrode 20.

For the breaking operation, the movable electrode holder 24 is moved by the drive mechanism (not shown), so that the movable electrode 20 is shifted away from the stationary electrode 18 to the position shown in FIG. 1.

When the movable electrode 20 is separated from the stationary electrode 18, in a breaking operation, there is produced an arc between the both electrodes, thereby melting parts of the electrodes 18, 20, while metal particles are radially scattered towards the inner surface of the insulating cylindrical body 12. The arc thus produced is broken according to an arc diffusing action in vacuum at the first current-zero-point subsequent to separation of both electrodes 18, 20. As a result, the arc will be extinguished before the movable electrode 20 reaches the final breaking condition, while the drive speed of the movable electrode holder 24 is so predetermined that the movable shield 28 will assume a position shown by a two-dot chain line in FIG. 1, so that the movable shield 28 substantially closes the opening at one end **34*b* of the intermediate metal shield 34, thus preventing the scattering of metal particles towards the inner surface of the insulating cylinder 30. On the other hand, on the stationary electrode side, one end 34*a* of the intermediate metal shield 34 and one end 36*b* of the first cylindrical metal shield 36, as well as the other end 36*b* of the first cylindrical metal shield 36 and the other end 36*a* of the end-plate cylindrical metal shield 38 are each overlapped in the axial direction, so that clinging of metal particles to the inner surface of the insulating cylinder 29 may be prevented. After breaking of a current, the movable electrode 20 will assume a final broken position as shown in FIG. 1, whereupon a circuit voltage will be impressed across the stationary electrode 18 and the movable electrode 20**.

Since one end **34*a* of the intermediate metal shield 34 and one end 36*b* of the first cylindrical metal shield 36, as well as the other end 36*a* of the first cylindrical metal shield 36 and one end 38*a* of the end-plate cylindrical metal shield 38 are overlapped each other, a stray capacitance C ($C_1$, $C_2$ in FIG. 1**) for each gap will be given by the following equation, in the case of the coaxial and identical-cylindrical-shape arrangement:

$$C = 2\pi\epsilon l/\log_e(R_2/R_1) \quad (1)$$

wherein $l$ = length of an overlapped portion
$R_1$ = radius of internal conductor
$R_2$ = radius of external conductor
$\epsilon$ = vacuum dielectric constant.

Since the other end **34*b* of the intermediate metal shield 34 and the movable shield 28 define a flat cylindrical gap therebetween, so that the stray capacitance $C_3$ (in FIG. 1**) is given by the following equation:

$$C_3 = 2\pi\epsilon/\log_e(2h/r) \quad (2),$$

wherein $h$ = distance between shields
r = radius at the end of the intermediate shield
$\epsilon$ = vacuum dielectric constant Accordingly, the potential of the intermediate metal shield 34 may be set to almost 50% in the final broken condition, while $C_1$ and $C_2$ are determined from the equation $C = C_1 \cdot C_2/C_1 + C_2$, which is a stray capacitance of the shield surrounding the stationary electrode holder 22 and then these values $C_1$, $C_2$ are rendered equal to a stray capacitance $C_3$ on the movable electrode holder side, so that the arrangement and construction of shields which satisfy a desired voltage withstanding performance may be achieved.

Since there is provided no shield outwardly of the movable shield 28, the diameter of the movable shield 28 may be increased to an extent close to the inner diameter of the insulating cylinder 30, so that the outer diameter and free length of the bellows 26 may be increased, thereby providing an increased electrode-to-electrode gap. Accordingly, the vacuum interrupter according to the present invention may be used as a vacuum interrupter of a high voltage class.

Figure 2:
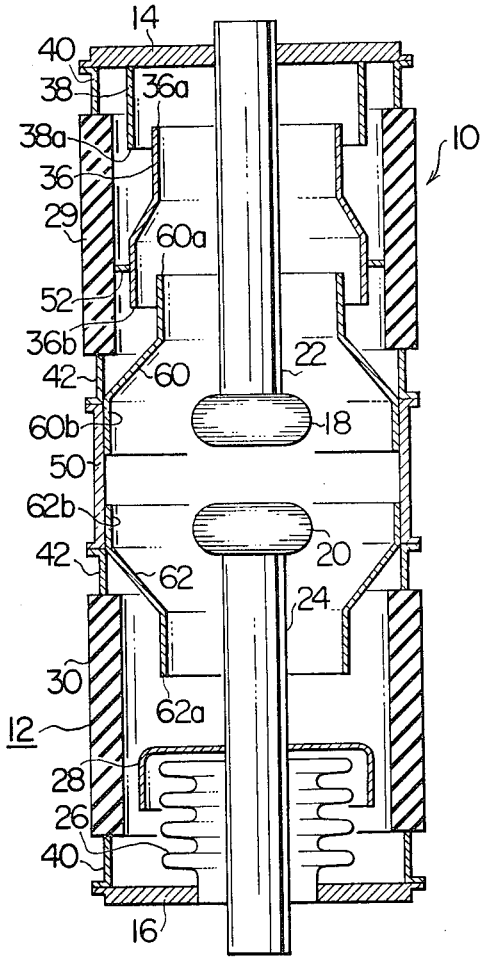
FIG. 2 and 3 are longitudinal cross-sectional views of different embodiments of the present invention.

FIG. 2 shows a construction of a vacuum interrupter of another embodiment of the invention. In this embodiment, the insulating cylindrical body 12 includes insulating cylindrical members or cylinders 29, 30 and a metallic cylinder 50 interposed therebetween. The intermediate metal shield is divided into two halves 60, 62 which extend in the axial direction. One end **60*b*, 62*b* of each of the intermediate metal shields 60, 62 are secured to the metal cylinder 50, while the other end 60*a*, 62*a* each thereof are opposed to the first cylindrical metal shield 36 and a movable shield 28**, respectively.

In this embodiment, a gap between one end **60*a* of the intermediate metal shield 60 and one end 36*b* of the first cylindrical metal shield 36, as well as a gap between the other end 62*a* of the intermediate metal shield 62 and the movable shield 28 are so predetermined that a stray capacitance $C_o$ of a shield surrounding the stationary electrode holder 22 may be equal to a stray capacitance $C_3$ on the movable electrode holder side, as in the case of FIG. 1**.

Accordingly, advantages equivalent to those of the first embodiment shown in FIG. 1 may be achieved.

Figure 3:
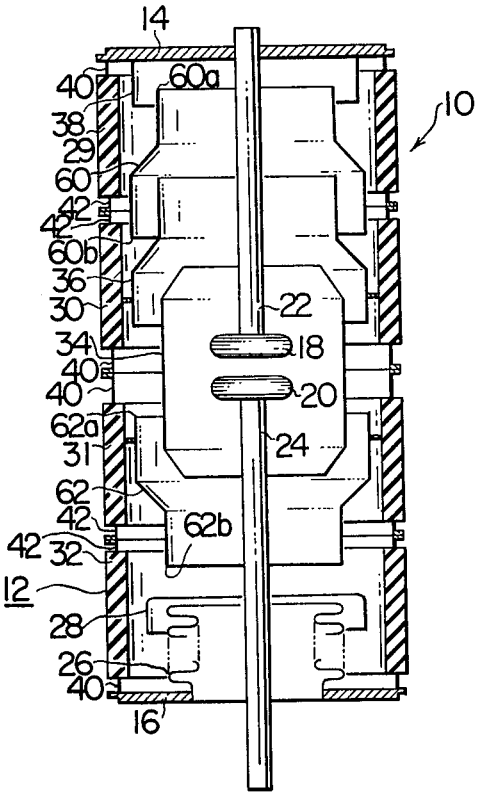

FIG. 3 shows a construction of a vacuum interrupter of a still another embodiment of the invention.

In this embodiment, the insulating cylindrical body 12 consists of four insulating cylindrical members or cylinders 29, 30, 31, 32. A second cylindrical metal shield 60 is positioned between a first cylindrical metal shield 36 and an end-plate cylindrical metal shield 38, such as shown in FIGS. 1 and 2, within the insulating cylindrical body 12. The second cylindrical metal shield 60 is secured electrically insulated relation to metal flanges 42 sandwiched between the insulating cylinders 29 and 30, while the axially opposed ends **60*b*, 60*a* of the second cylindrical metal shield 60 overlap the respective ends of the first cylindrical metal shield 36 and end-plate cylindrical metal shield 38**, in the axial direction.

In addition, a third cylindrical metal shield 62 is placed between the intermediate metal shield 34 and the movable shield 28, while one end **62*a* thereof surrounds the intermediate metal shield 34, and the other end thereof is opposed to the movable shield 28. The third cylindrical metal shield 62 is secured to an insulating cylinder 31** in electrically insulated relationship.

In this embodiment as well, the overlapping length and diameters of the respective shields are so predetermined that, as in the embodiments shown in FIGS. 1 and 2, a stray capacitance of a shield surrounding the stationary electrode holder 22 is equal to a stray capacitance of a shield surrounding the movable electrode holder 24, so that the advantages similar to those obtained from the embodiments shown in FIGS. 1 and 2 may be achieved. With the aforesaid arrangement, there may be achieved uniform distribution of voltage impressed on the insulating cylinders 29, 30, 31, 32, respectively.

According to this embodiment, four insulating cylinders are used, so that an external insulating distance may be further increased. As a result, there may be achieved a vacuum interrupter of a higher voltage class than those shown in FIGS. 1 and 2.

As is apparent from the foregoing, according to the vacuum interrupter for use in a vacuum breaker, an intermediate metal shield is provided, which is electrically insulated from a pair of electrodes separable from each other; a half part of the intermediate shield and at least two cylindrical metal shields are provided on the side of the stationary electrode holder, with each pair of ends thereof in the axial direction being overlapped in surrounding relation, while the intermediate shield and at least two cylindrical metal shields are secured to different potential portions, respectively; the other half part of the aforesaid intermediate metal shield and at least a movable shiled are provided in axially opposed relation on the side of the movable electrode holder, to which the movable electrode is secured, with the diameter of the movable shield being larger than the diameter of the aforesaid intermediate metal shield; so that the inner surface of the insulating cylindrical body as well as a bellows may be protected from clinging of metal particles produced at the time of breaking a current; and in addition, voltage distribution on the outer peripheral surface of the insulating cylindrical body may be improved, thereby providing a vacuum interrupter for use in a vacuum breaker which is well adapted for use as a vacuum interrupter of a high voltage class.

What is claimed is:

1. A vacuum interrupter for use in a vacuum breaker including: an insulating cylindrical body having at least two insulating cylindrical members with metal flanges secured to their respective ends, at least opposed ones of said metal flanges of said insulating cylindrical members being mated with each other to form said insulating cylindrical body; end plates secured to the metal flanges at the opposite ends of said insulating cylindrical body, respectively; a pair of separable stationary and movable electrodes which are secured to respective stationary and movable electrode holders and disposed within said insulating cylindrical body; a bellows positioned between said movable electrode holder and one of said end plates for moving said movable electrode in an air-tight relation; an intermediate metal shield electrically insulated from said pair of electrodes and secured to said insulating cylindrical body so as to extend inwardly of said insulating cylindrical body in surrounding relation to said electrodes for protecting said insulating cylindrical body from clinging of metal vapor or particles produced; a movable shield secured to said movable electrode holder in a manner to cover said bellows; a first cylindrical metal shield electrically insulated from and surrounds said stationary electrode holder to which said stationary electrode is secured, said first cylindrical metal shield being opposed to said intermediate metal shield and secured to a potential portion other than said intermediate metal shield; and an end cylindrical metal shield opposed to said cylindrical metal shield and secured to said end plate on the stationary electrode holder side; wherein an end portion of said first cylindrical metal shield which is opposed to one end of said intermediate metal shield, and an end portion of said end cylindrical metal shield which is opposed to the other end of said first cylindrical metal shield, each surround the corresponding end portions of said intermediate metal shield and said first cylindrical metal shield, respectively; and the diameter of said movable shield secured to said movable electrode holder is larger than the diameter of the end portion of said intermediate metal shield on the movable electrode side.

2. A vacuum interrupter for use in a vacuum breaker as set forth in claim 1, wherein a metal cylinder is provided adjacent to said pair of electrodes and secured to said opposed metal flanges of said insulating cylindrical members, and said intermediate metal shield is divided into two halves in the axial direction of said electrode holders, said two halves surrounding the outer peripheries of said electrode holders and being each secured to the opposite ends of said metal cylinder.

3. A vacuum interrupter for use in a vacuum breaker as set forth in claim 1, wherein a second cylindrical metal shield is positioned between said first cylindrical metal shield and said end plate cylindrical metal shield in opposed relation with each end thereof being opposed to the ends of said first cylindrical metal shield and said end cylindrical metal shield, said second cylindrical metal shield being electrically insulated from said first cylindrical metal shield and said end cylindrical metal shield; an end portion of said second cylindrical metal shield which is opposed to said first cylindrical metal shield, and an end portion of said end plate cylindrical metal shield which is opposed to the other end of said second cylindrical metal shield, each surround corresponding ends of said first cylindrical metal shield and said second cylindrical metal shield respectively; a third cylindrical metal shield is positioned between said intermediate metal shield and said movable shield in opposed relation with each end thereof being opposed to the ends of said intermediate metal shield and said movable shield, respectively, said third cylindrical metal shield being insulated from said intermediate metal shield and said movable shield, respectively; and an end portion of said third cylindrical metal shield which is opposed to said intermediate metal shield surrounds a corresponding end of said intermediate metal shield; the other end of said third cylindrical metal shield being positioned in opposed relation to said movable shield.

4. A vacuum interrupter for use in a vacuum breaker as set forth in claim 1, wherein said intermediate metal shield, said first cylindrical metal shield, said end metal shield and said movable shield are positioned in asymmetrical relation in the axial direction, with respect to the contacting surfaces of said pair of electrodes.

5. A vacuum interrupter for use in a vacuum breaker as set forth in claim 1, wherein said movable shield having a larger diameter than the diameter of the end portion of said intermediate metal shield on the movable electrode side enables a large diameter bellows and an increased path length of movement for said movable electrode with an increased electrode-to-electrode gap for high voltage use.

6. A vacuum interrupter for use in a vacuum breaker as set forth in claim 5, wherein said movable shield is a cup-shaped member extending at least partially over said bellows.

7. A vacuum interrupter for use in a vacuum breaker as set forth in claim 1, wherein said movable shield having a larger diameter than the diameter of the end portion of said intermediate metal shield on the movable electrode side enables a vacuum interrupter having sufficient voltage withstanding performance for high voltage use without the need of a cylindrical metal shield and an end cylindrical metal shield on said movable electrode side corresponding respectively to said first cylindrical metal shield and said end cylindrical metal shield provided on said stationary electrode side.

8. A vacuum interrupter for use in a vacuum breaker as set forth in claim 7, wherein said movable shield is a cup-shaped member extending at least partially over said bellows.

9. A vacuum interrupter for use in a vacuum breaker as set forth in claim 1, wherein said movable shield having a larger diameter than the diameter of the end portion of said intermediate metal shield on the movable electrode side substantially closes the end portion of said intermediate metal shield on the movable electrode side at least at the initial interruption of current through said vacuum breaker thereby protecting said insulating cylindrical body from clinging of metal vapor or particles produced.

10. A vacuum interrupter for use in a vacuum breaker as set forth in claim 9, wherein said movable shield is a cup-shaped member extending at least partially over said bellows.

* * * * *